US010765606B1

(12) United States Patent
Murillo et al.

(10) Patent No.: US 10,765,606 B1
(45) Date of Patent: Sep. 8, 2020

(54) METHOD AND APPARATUS FOR BABY BOTTLE HOLDER

(71) Applicants: Joseph Murillo, Pflugerville, TX (US); Roy Paul Prosise, Cedar Park, TX (US)

(72) Inventors: Joseph Murillo, Pflugerville, TX (US); Roy Paul Prosise, Cedar Park, TX (US)

( * ) Notice: Subject to any disclaimer, the term of this patent is extended or adjusted under 35 U.S.C. 154(b) by 331 days.

(21) Appl. No.: 14/034,474

(22) Filed: Sep. 23, 2013

Related U.S. Application Data

(60) Provisional application No. 61/703,841, filed on Sep. 21, 2012.

(51) Int. Cl.
*A61J 9/06* (2006.01)

(52) U.S. Cl.
CPC ..... *A61J 9/0669* (2015.05); *A61J 9/06* (2013.01); *A61J 9/063* (2015.05); *A61J 9/0607* (2015.05); *A61J 9/0623* (2015.05); *A61J 9/0638* (2015.05); *A61J 9/0676* (2015.05); *A61J 9/0684* (2015.05); *A61J 9/0692* (2015.05)

(58) Field of Classification Search
CPC .. A61J 9/06; A61J 9/0623; A61J 9/063; A61J 9/0638; A61J 9/0669; A61J 9/0676; A61J 9/0684; A61J 9/0692; A61J 9/0607
USPC ..... 248/102, 103, 104, 105, 106
See application file for complete search history.

(56) References Cited

U.S. PATENT DOCUMENTS 1,571,826 A * 2/1926 Wellenhoffer ..... A61J 9/06 248/107
1,729,531 A * 9/1929 Wolever ..... A61J 9/06 248/105
2,033,296 A * 3/1936 Porter ..... A61J 9/06 248/102
2,264,489 A * 12/1941 Tiegler ..... A47G 23/0241 174/138 F
2,301,216 A * 11/1942 Koontz ..... A47G 23/0241 248/152
2,451,846 A * 10/1948 Love ..... A61J 9/06 248/105
3,058,708 A * 10/1962 Murray ..... A61J 9/06 248/102

(Continued)

FOREIGN PATENT DOCUMENTS

DE 3021110 A1 * 12/1981 ..... A47G 23/0241
JP WO 2014092190 A1 * 6/2014 ..... A61J 9/0669

(Continued)

*Primary Examiner* — Eret McNichols
(74) *Attorney, Agent, or Firm* — Rick B. Yeager

(57) ABSTRACT

A baby bottle holder for supporting a baby bottle in a manner that allows a baby to feed from a baby bottle. A substantially planar support frame has a bottom portion, a top portion with a rounded first side and a rounded second side with an opening configured to accept a portion of a baby bottle. A first side portion of the support frame is spaced apart from a second side portion, so that a baby can grasp one or both side portions. A bottle gripping element lines the opening. In one example, the bottle gripping element is a thin layer of rubbery material. In another example, the bottle gripping element includes a compliant seal portion adapted to accepting bottles of various diameters. In various examples, the frame includes rattles, movable elements such as rotatable wheels, or decorative elements such as "ears".

14 Claims, 8 Drawing Sheets

(56) References Cited

U.S. PATENT DOCUMENTS 3,216,687 A * 11/1965 Vardan ..... A61J 9/06 248/103
3,463,536 A * 8/1969 Beyer ..... A47J 45/077 215/396
3,773,287 A * 11/1973 Hechinger ..... A61J 9/06 19/159 A
3,850,393 A * 11/1974 Marquard ..... A61J 9/0676 248/102
3,990,596 A * 11/1976 Hoftman ..... A61J 9/06 215/11.1
4,309,008 A 1/1982 Sirks
4,943,017 A * 7/1990 Ennis ..... A61J 9/06 215/11.1
5,072,843 A * 12/1991 James ..... A61J 9/06 215/11.1
D329,964 S * 10/1992 Dobbins ..... D7/619.1
D334,983 S * 4/1993 Nicholls ..... D24/195
5,513,885 A * 5/1996 Joffe ..... A61J 9/06 215/396
5,711,500 A * 1/1998 De Los Santos ..... A61J 9/06 248/102
5,769,367 A * 6/1998 Bradley ..... A61J 9/06 248/102
5,794,898 A 8/1998 Bradley
5,806,904 A * 9/1998 Smith ..... B65D 23/104 215/396
6,915,991 B1 7/2005 Shomar et al.
6,986,487 B2 * 1/2006 Rich ..... A61J 9/06 248/104
7,080,810 B2 * 7/2006 Munjed ..... A61J 9/06 248/102
7,216,837 B2 * 5/2007 Pineda ..... A47G 7/025 248/104
8,152,012 B1 * 4/2012 Berglund ..... A45F 5/10 16/425
8,281,435 B2 * 10/2012 Kent ..... A47D 13/08 248/102
8,282,518 B2 * 10/2012 Silverglate ..... A63B 39/00 215/11.6
2006/0273059 A1 * 12/2006 Mendenhall ..... A61J 9/00 215/11.1
2013/0098932 A1 * 4/2013 Hunt ..... A61J 9/06 220/772
2013/0264437 A1 * 10/2013 Amitai ..... A61J 9/06 248/104
2013/0324006 A1 * 12/2013 Marshall ..... A63H 3/28 446/297
2014/0138396 A1 * 5/2014 Altermatt ..... A61J 9/06 220/737

FOREIGN PATENT DOCUMENTS

JP 2014133083 A * 7/2014 ..... A61J 9/0669
WO WO 2016028928 A2 * 2/2016 ..... A61J 9/0623

* cited by examiner

METHOD AND APPARATUS FOR BABY BOTTLE HOLDER

RELATED APPLICATIONS

This US non-provisional patent application is related to U.S. Provisional patent application No. 61/703,841 filed on Sep. 21, 2013, and claims the benefit of that filing date.

BACKGROUND

Field of Invention

The current invention relates to a baby bottle holder for supporting a baby bottle in a manner that allows a baby to feed from a baby bottle.

Prior Art

Prior art devices for holding a baby bottle in a particular orientation. FIGS. 1A and 1B are from U.S. Pat. No. 5,794,898 to Bradley et al for "Nursing bottle propping apparatus". That reference describes an apparatus for propping a nursing bottle so that an infant child can drink from the bottle includes a bottle holding portion; and an apparatus mounting portion including at least two mutually diverging first flexible members for abutting the sides of the torso of an infant child to removably secure the apparatus to the child with friction engagement. The first flexible members preferably each include a skeleton segment of ductile material for bending by hand to conform to and fit against the waist of an individual child. The first flexible members alternatively each include a skeleton segment of resilient material having elastic memory and pre-shaped to lightly resiliently grip the front and sides of the infant waist. The first flexible members are preferably at least partly covered with a high friction material. The high friction material may be non-toxic rubber tubing. The bottle holding portion preferably includes at least two mutually diverging second flexible members for abutting the sides of the nursing bottle to removably secure the nursing bottle in the apparatus. The apparatus preferably additionally includes a ductile and flexible connecting link interconnecting the bottle holding portion and the apparatus mounting portion, for positioning the nursing bottle holding portion, and thereby positioning the bottle, relative to the mouth of the child.

FIGS. 2A and 2B are from U.S. Pat. No. 6,915,991 to Shomer et al for "Bottle retainer for a baby". That reference describes a manually bendable strip made from a stainless steel ribbon within a vinyl sheath. The sheath with the stainless steel ribbon are encased within a casing made from a soft fabric. A central region of the strip is a bottle holder in the shape of an open ended ring. Ends of the ring form tongs that can fit onto a baby's torso. A fabric strip is tied about a junction formed by the bottle holder and the tongs.

FIG. 3 is from U.S. Pat. No. 4,309,008 to Sirks for "Baby bottle holder". That reference describes a baby feeder having front and rear plate members and a leaf member configured for interconnecting the other two adjacent the midpoint thereof for forming an easel, the front plate member having a pocket in the upper edge thereof configured for receiving a baby bottle. Each of the front and rear plate members and leaf member are provided with apertures aligned and configured for receiving a single strand of an elastic member which is interlaced through the apertures to provide a hingeable connection between the leaf member and the front and rear plate members, the elastic member also forming a harness for retaining a baby bottle in the pocket in a baby feeding position. There is also provided beads at the front and rear of said harness for adjusting tension to accommodate different size lengths and widths of said bottle.

SUMMARY OF INVENTION

In one embodiment of the current invention, a substantially planar support frame is provided. The support frame has a bottom portion, a top portion with a rounded first side and a rounded second side with an opening configured to accept a portion of a baby bottle. A first side portion of the support frame is spaced apart from a second side portion, so that a baby can grasp one or both side portions. A bottle gripping element lines the opening.

In one example, the bottle gripping element is a thin layer of rubbery material. In another example, the bottle gripping element includes a compliant seal portion adapted to accepting bottles of various diameters.

In various examples, the frame includes rattles, movable elements such as rotatable wheels, or decorative elements such as "ears".

DETAILED DESCRIPTION OF INVENTION

Baby Bottle Holder

Figure 1A:
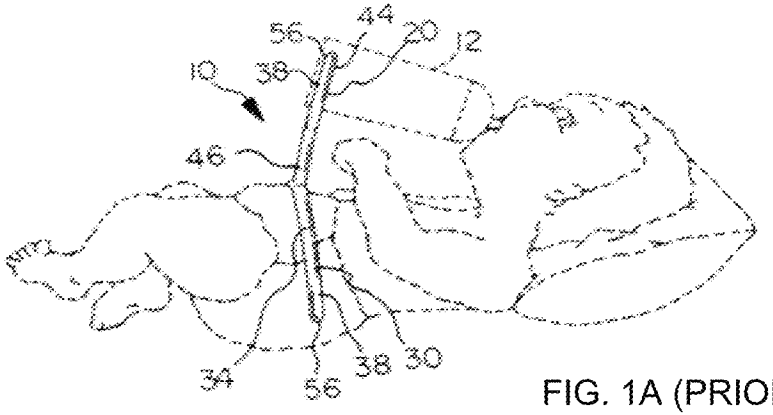
FIG. 1A (PRIOR ART)
FIGS. 1A and 1B show prior art from U.S. Pat. No. 5,794,898 to Bradley et al for "Nursing bottle propping apparatus".
Figure 1B:
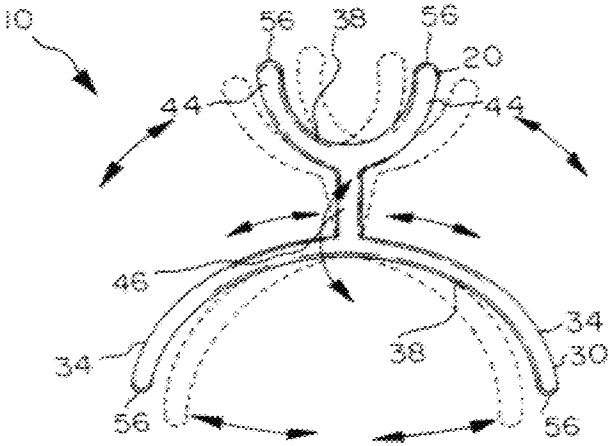
FIG. 1B (PRIOR ART)
Figure 2A:
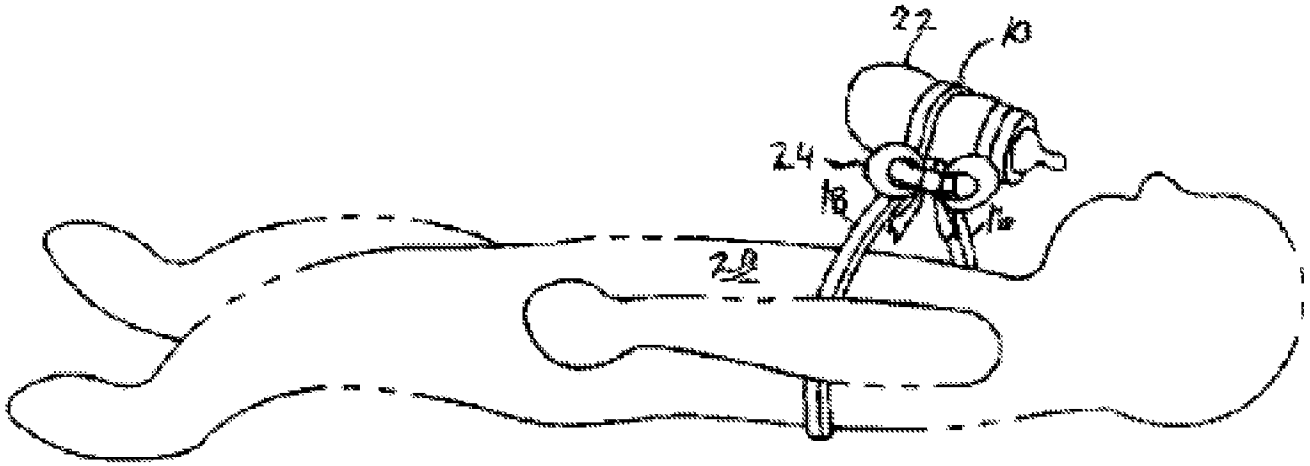
FIG. 2A (PRIOR ART)
FIGS. 2A and 2B show prior art from U.S. Pat. No. 6,915,991 to Shomer et al for "Bottle retainer for a baby".
Figure 2B:
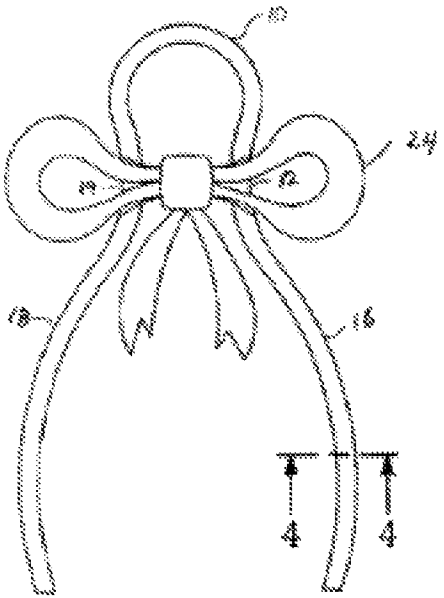
FIG. 2B (PRIOR ART)
Figure 3:
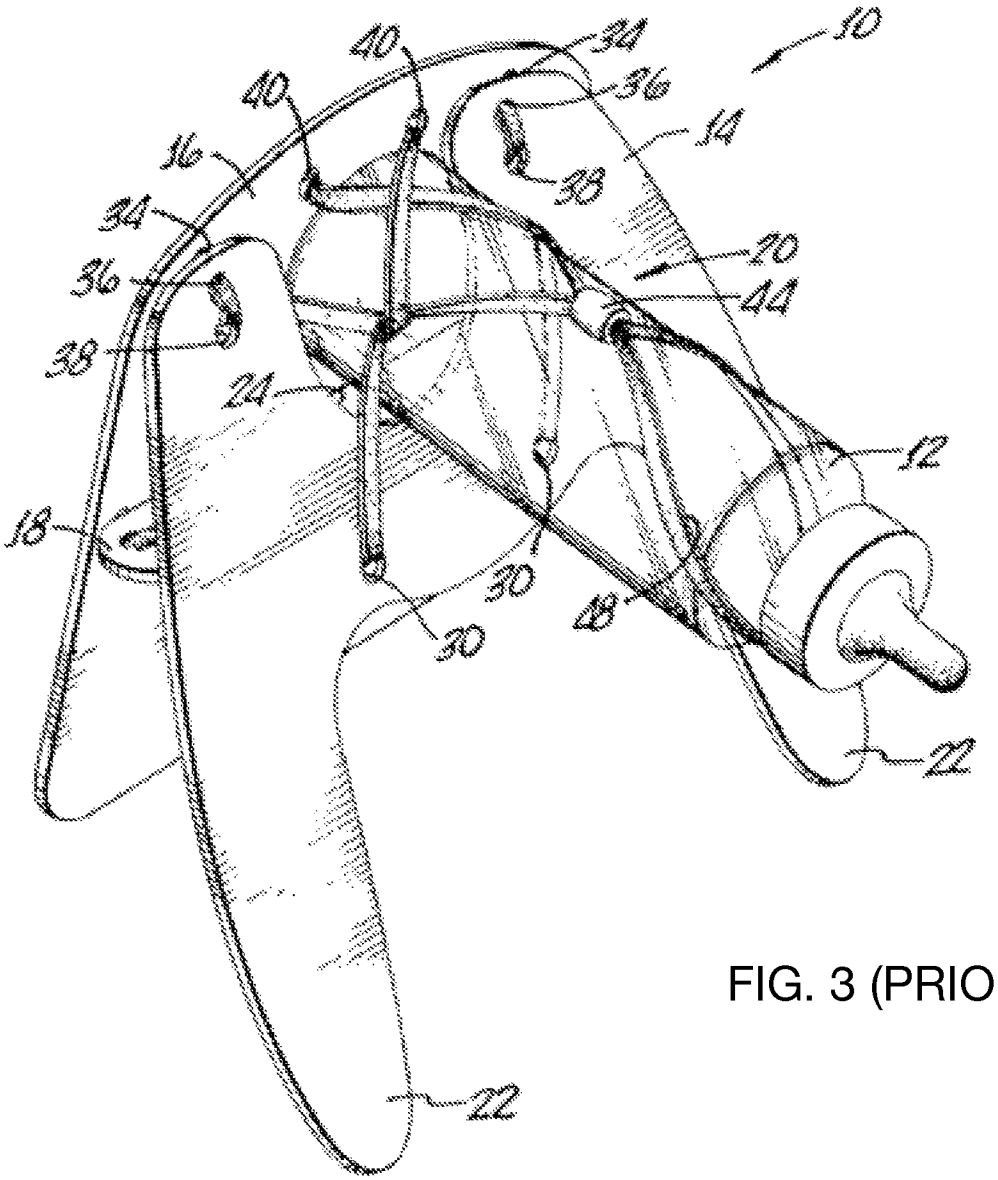
FIG. 3 (PRIOR ART)
FIG. 3 show prior art from U.S. Pat. No. 4,309,008 to Sirks for "Baby bottle holder".
Figure 4C:
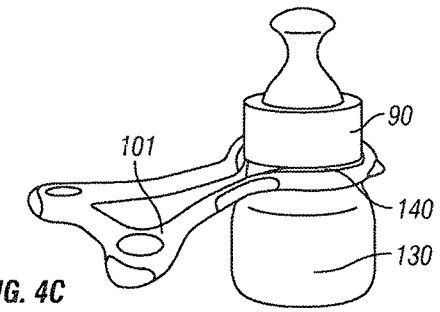
FIG. 4C is a top perspective view of the baby bottle holder of FIG. 4A with a baby bottle.
Figure 4D:
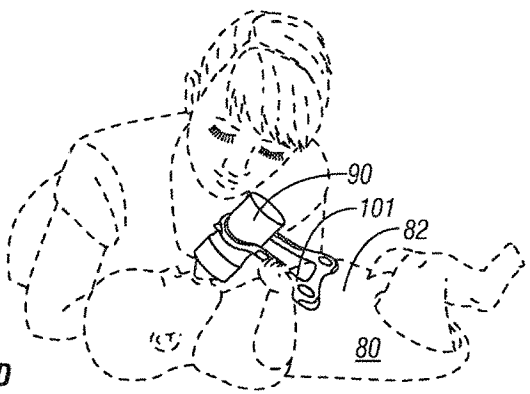
FIG. 4D is a side view of the baby bottle holder and baby bottle FIG. 4A placed on a baby's torso.
Figure 4A:
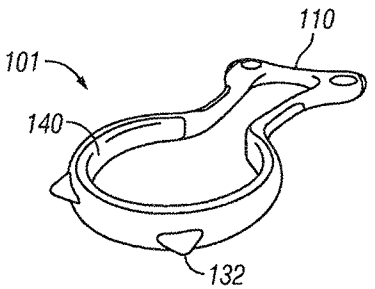
FIG. 4A is a top perspective view of a first embodiment of a baby bottle holder.

FIGS. 4A-4D show a first embodiment of a baby bottle holder 101. FIG. 4A is a top perspective view of the first embodiment of the baby bottle holder 101 with a substantially planar support frame including a bottom portion 110, a bottle gripping element 140, and decorative ears 131 and 132. In this example, the bottle gripping element is a rubbery material which provides a compliant and high friction surface to accept and grip a baby bottle. The bottle gripping element may be provided in a different color than the top and bottom portions of the support frame. In other examples, the bottle gripping may be a portion of the inside surface of the support frame.

Figure 4B:
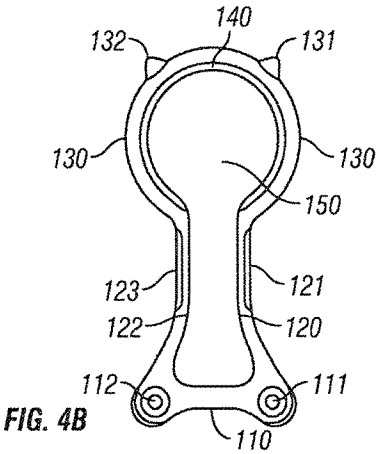
FIG. 4B is a top view of the baby bottle holder of FIG. 4A

FIG. 4B is a top view of the baby bottle holder of FIG. 4A showing rattles 111 and 112, a first side 120 with a decorative grip 121, a second side 122 with a decorative grip 123, an open-ring top portion 130 with a opening 150 to accept a baby bottle 90.

FIG. 4C is a top perspective view of the baby bottle holder 101 of FIG. 4A with a baby bottle. FIG. 4D is a side view of the baby bottle holder 101 and baby bottle 90 of FIG. 4A placed on the torso 82 of a baby 80.

In this specification, the term "substantially planar support frame" means that the plane of the top portion is the same as the plane of the side portions; or that the plane of the top portion has an angle of less than 20 degrees relative to the plane of the side portions.

In one example, the bottom portion has a width of less than 4 inches so that the bottom portion can rest on a baby's torso.

Figure 5:
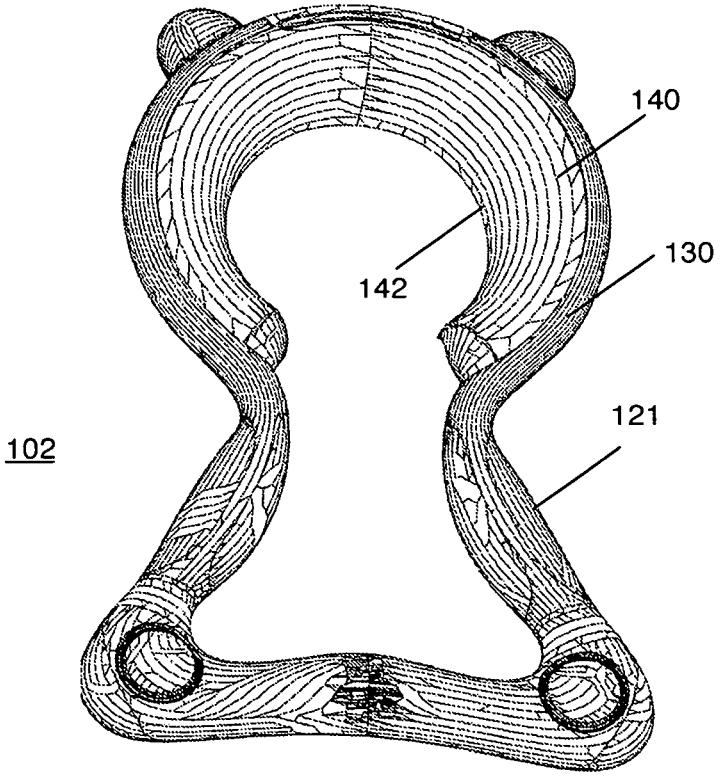
FIG. 5 is a top perspective view of a second embodiment of a baby bottle holder with a compliant membrane.

FIG. 5 is a top perspective view of a second embodiment 102 of a baby bottle holder with a compliant membrane 142 extension of the bottle gripping element 140. In this example, the compliant membrane 142 will accept and hold bottles of various diameters and shapes.

FIGS. 6A-6D show a third embodiment 103 of baby bottle holders with handles 124 and 125.

Figure 6C:
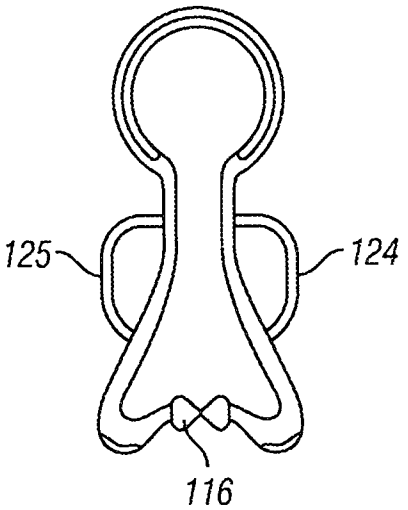
FIG. 6C is a top view of the baby bottle holder of FIG. 6B.
Figure 6D:
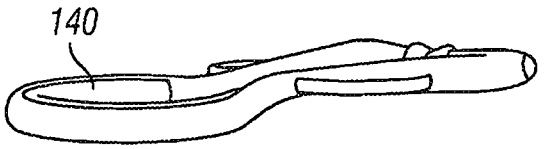
FIG. 6D is a side perspective view of the baby bottle holder of FIG. 6B.
Figure 6A:
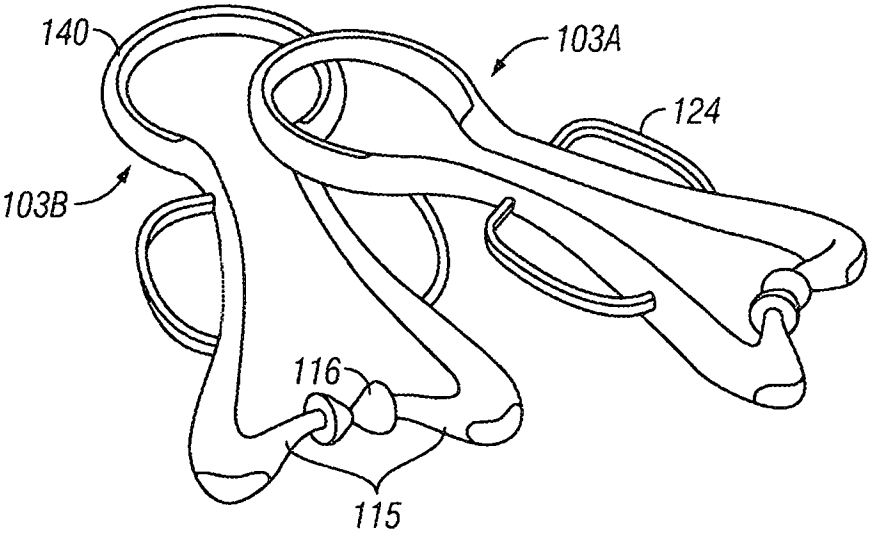
FIG. 6A is a top perspective view of a third embodiment of baby bottle holders with handles.

FIG. 6A is a top perspective view of a baby bottle holders 103A and 103B where the bottom has an offset portion to accept wheel moving elements 116 for the baby's entertainment.

Figure 6B:
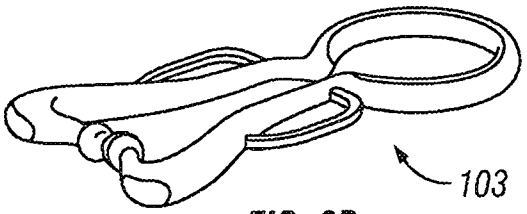
FIG. 6B is a top perspective view of a third embodiment of baby bottle holder of FIG. 6A.

FIG. 6B is a top perspective view of a baby bottle holder 103. FIG. 6C is a top view of the baby bottle holder 103 of FIG. 6B. FIG. 6D is a side perspective view of the baby bottle holder of FIG. 6B showing a portion of a bottle gripping element 140.

Figure 7:
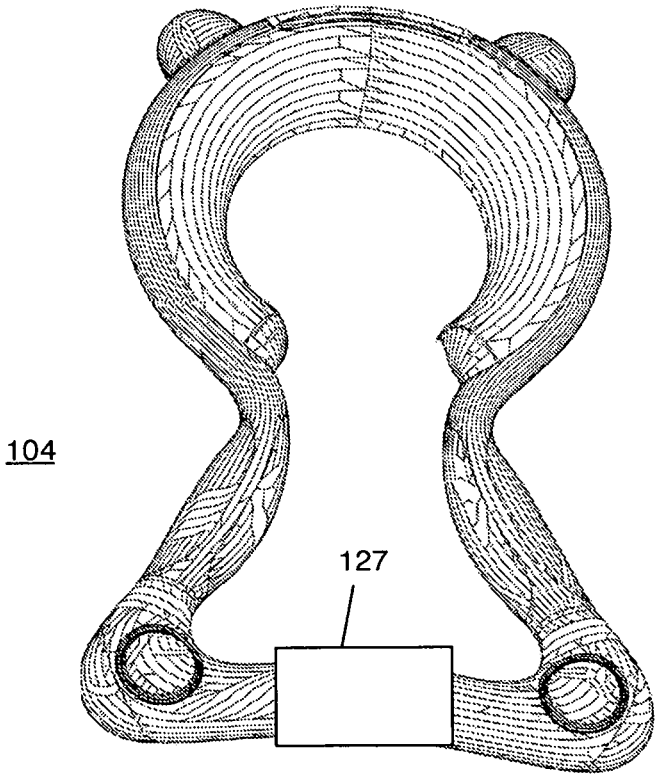
FIG. 7 is a top perspective view of a fourth embodiment of a baby bottle holder.

FIG. 7 is a top perspective view of a fourth embodiment 104 of a baby bottle holder with a baby toy 127 on the bottom portion of the support frame. Other embodiments of a baby bottle holder may have a variety of shapes of the support frame and various accent features.

Compliant Top Portion

Figure 8C:
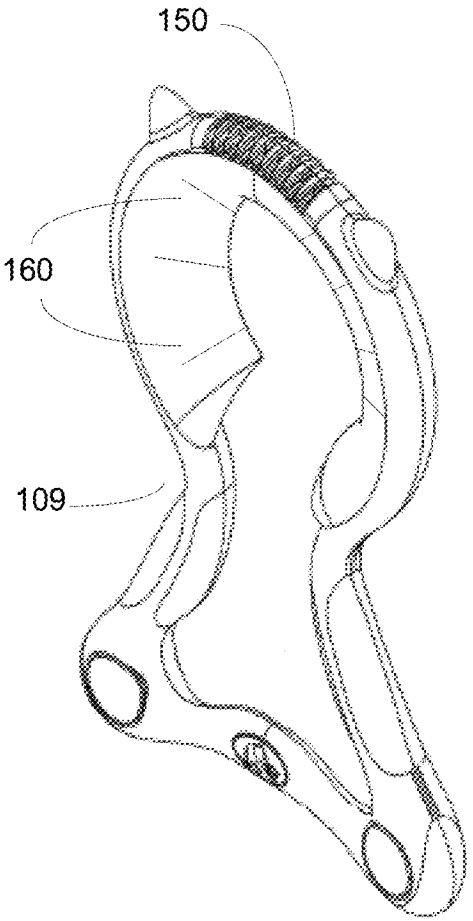
FIG. 8C is a perspective view of the embodiment of FIG. 8A.
Figure 8B:
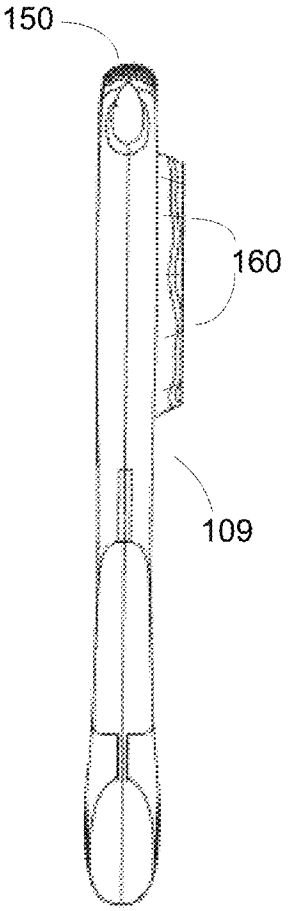
FIG. 8B is a side view of the embodiment of FIG. 8A.
Figure 8A:
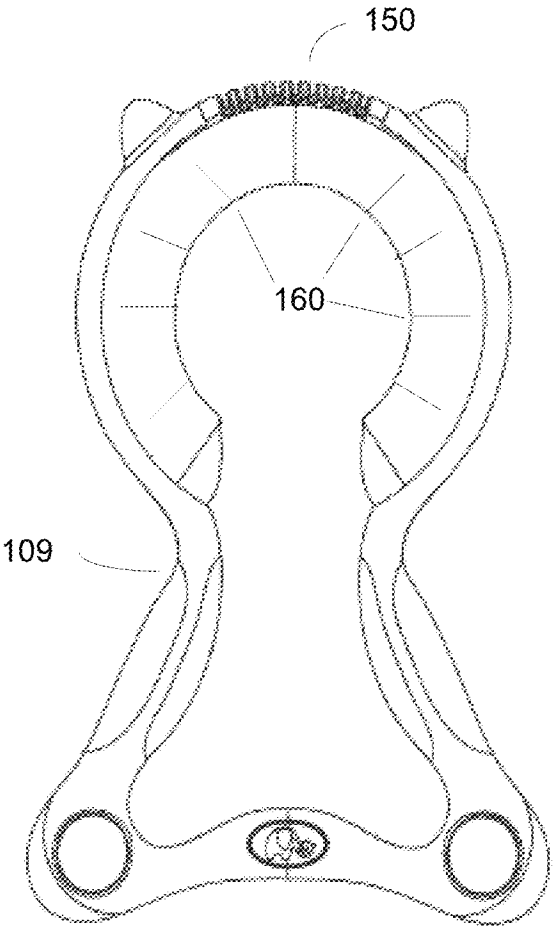
FIG. 8A is a top view of an embodiment of a baby bottle holder with a compliant portion.

FIG. 8A is a top view of an embodiment of a baby bottle holder 109 with a compliant portion 150 in the top of the support frame. FIG. 8B is a side view of the embodiment of FIG. 8A. FIG. 8C is a perspective view of the embodiment of FIG. 8A. In this example the complaint portion permits a stretching of the frame to accept larger diameter bottles. These figures also show slits 160 in the compliant membrane, where the slits facilitate insertion of a bottle.

Method of Use

In one example of use, a baby bottle is inserted into the opening so that the nipple portion of the bottle extends from the opening. The bottle is held in the support frame by either tension from the support frame or by compression of a compliant bottle gripping element or membrane.

The baby bottle holder with bottle is then offered to the baby in a configuration where the bottom portion of the support frame rests on the baby's torso. The baby can then grasp the sides of the frame and can pull the bottle forward or push it away.

There are many advantages of the baby bottle holder, including its small size and flat shape which facilitates packing into a diaper bag and convenient travel; it can fit a variety of bottle sizes; it matches a natural nursing posture; it encourages the development of the baby; and no set-up or adjustment is required for its use.

The scope of the invention is not limited to the particular examples and embodiments described above.

What is claimed is:

1. A nursing bottle holder comprising a substantially planar support frame comprising a partially circular top portion having a diameter and comprising a rounded first side having an inside surface, a top, and a bottom, a rounded second side having an inside surface, a top, and a bottom, the rounded second side spaced apart from the rounded first side, and an opening between the rounded first side and the rounded second side, the opening configured to accept a portion of a baby bottle, such that the top of the rounded first side is joined to the top of the rounded second side, and the bottom of the rounded first side is spaced apart from the bottom of the second rounded side, an arced bottom portion having a first side, a second side, and having a length greater than or equal to the diameter of the top portion, a rounded elongated first side member having a first thickness defined by a first outer surface and a substantially parallel first inner surface, wherein the first thickness is configured to be grasped by a baby, extending from the arced bottom first side to the rounded first side bottom, and a rounded elongated second side member having a second thickness defined by a second outer surface and a substantially parallel second inner surface, wherein the second thickness is configured to be grasped by a baby, spaced apart from the rounded elongated first side member, and extending from the arced bottom second side to the rounded second side bottom; and a bottle gripping element lining at least a portion of the inside surface of the rounded first side, and lining at least a portion of the inside surface of the rounded second side.

2. The nursing bottle holder of claim 1 further comprising a first handle provided on the rounded elongated first side member; and a second handle provided on the rounded elongated second side member.

3. The nursing bottle holder of claim 1 further comprising one or more rattle provided on the support frame.

4. The nursing bottle holder of claim 1 further comprising one or more moving elements provided on the support frame.

5. The nursing bottle holder of claim 1 further comprising one or more decorative features provided on the support frame.

6. The nursing bottle holder of claim 5 wherein the decorative features are a pair of ears provided on the top portion of the support frame.

7. The nursing bottle holder of claim 1 wherein the bottle gripping element is a compliant material.

8. The nursing bottle holder of claim 7 wherein the bottle gripping element further comprises a compliant membrane, such that the membrane will accept and hold bottles of different diameters.

9. The nursing bottle holder of claim 8 wherein a plurality of slits are provided in the compliant membrane.

10. The nursing bottle holder of claim 1 wherein the top portion comprises an open ring.

11. The nursing bottle holder of claim 10 wherein the top portion further comprises a compliant section.

12. The nursing bottle holder of claim 1 wherein the top portion has a gap between the bottom of the rounded first side and the bottom of the rounded second side.

13. The nursing bottle holder of claim 1 wherein the bottom portion has a width of less than 4 inches, such that the bottom portion is configured to be placed on top of a baby's stomach or chest.

14. A method of supporting a nursing bottle for a nursing baby, the method comprising providing a nursing bottle holder comprising a substantially planar support frame comprising a partially circular top portion having a diameter and comprising a rounded first side having an inside surface, a top, and a bottom, a rounded second side having an inside surface, a top, and a bottom, the rounded second side spaced apart from the rounded first side, and an opening between the rounded first side and the rounded second side, the opening configured to accept a portion of a baby bottle, such that the top of the rounded first side is joined to the top of the rounded second side, and the bottom of the rounded first side is spaced apart from the bottom of the second rounded side, an arced bottom portion having a first side, a second side, a rounded elongated first side member having a first thickness defined by a first outer surface and a substantially parallel first inner surface, wherein the first thickness is configured to be grasped by a baby, extending from the arced bottom first side to the rounded first side bottom, and a rounded elongated second side member having a second thickness defined by a second outer surface and a substantially parallel second inner surface, wherein the second thickness is configured to be grasped by a baby, spaced apart from the rounded elongated first side member, and a bottle gripping element lining at least a portion of the inside surface of the rounded first side, and lining at least a portion of the inside surface of the rounded second side;

inserting a nursing bottle into the opening in the top portion; and placing the nursing bottle holder on a baby's stomach or chest.

* * * * *